US006173872B1

(12) United States Patent
Cohen

(10) Patent No.: US 6,173,872 B1
(45) Date of Patent: Jan. 16, 2001

(54) CREASE-FREE COMBINATION HANGER

(75) Inventor: Bernard J. Cohen, Spring Valley, NY (US)

(73) Assignee: The Accessory Corp., New York, NY (US)

( * ) Notice: Under 35 U.S.C. 154(b), the term of this patent shall be extended for 0 days.

(21) Appl. No.: 09/007,963

(22) Filed: Jan. 16, 1998

Related U.S. Application Data

(63) Continuation-in-part of application No. 08/882,048, filed on Jun. 25, 1997, now abandoned, which is a continuation-in-part of application No. 08/798,584, filed on Feb. 10, 1997, now abandoned.

(51) Int. Cl.[7] ..... A47G 25/48
(52) U.S. Cl. ..... 223/96; 24/507
(58) Field of Search ..... 233/95, 96, 93, 233/91, 85, 90; 24/507

(56) References Cited

U.S. PATENT DOCUMENTS 2,008,624 * 7/1935 Mix ..... 24/507
3,767,092 * 10/1973 Garrison et al. ..... 223/96
3,914,628 * 10/1975 Noda ..... 24/507
3,984,037 * 10/1976 Peterson ..... 223/96
4,194,274 * 3/1980 Garrison ..... 223/96
5,183,190 * 2/1993 Zuckerman ..... 223/96
5,361,948 * 11/1994 Batts ..... 223/96
5,398,854 * 3/1995 Blanchard ..... 223/96

* cited by examiner

*Primary Examiner*—Bibhu Mohanty
(74) *Attorney, Agent, or Firm*—David P. Gordon; David S. Jacobson; Thomas A Gallagher

(57) ABSTRACT

A clamp-type garment hanger defined by a pair of opposed jaw members between which a garment is hung. The opposed jaw members have gripping members and opposed gripping surfaces. The gripping members, opposed gripping surfaces and jaw members of one jaw member are formed from the same material, which may include either polystyrene, polypropylene, polyethylene, styrene-butadiene copolymers and blends, or polycarbonates. The other jaw member has bonded thereto an elastomer material for gripping the garment. To increase the coefficient of friction of the opposed gripping surfaces, the surfaces may be treated by engraving, acid etching, electrical discharge machining, vapor honing, or sandblasting.

13 Claims, 2 Drawing Sheets

12
10
1
12

14
16
10

CREASE-FREE COMBINATION HANGER

This application is a continuation-in-part application of application Ser. No. 08/882,048 filed Jun. 25, 1997 now abandoned entitled "Garment Hanger With Integral Crease-Free Clips," which is a continuation-in-part of application Ser. No. 08/798,584 filed Feb. 10, 1997 now abandoned entitled "Garment Hanger With Integral Crease-Free Clips," all of which are hereby incorporated by reference.

BACKGROUND OF THE INVENTION

1. Field of the Invention

The present invention relates to hangers. More specifically, the present invention relates to a clamping-type garment hanger which prevents unwanted creases or imprints, and which is more economical to manufacture than clamping-type garment hangers heretofore in use.

2. Discussion of the Related Art

Clamping-type garment hangers have heretofore been provided for the suspension or hanging of articles such as pants, skirts, etc. Such hangers include at least one clamp typically defined by a pair of opposed clamp or jaw members between which the article is placed. Provision is made for biasing the members to create the clamping force necessary to retain the article between the inner surfaces of the jaw members. To further retain the article between the inner surfaces of the members, the clamp or jaw members have heretofore also included on its inner surfaces teeth elements or a friction surface separately attached to the inner surfaces of the clamp or jaw members.

For example, U.S. Pat. No. 4,194,274 to Garrison entitled "Garment Grip Construction for Hangers" discloses a clamping-type garment hanging device on which teeth 70 and 88 are placed to grip and secure the garment to the hanger. Also, U.S. Pat. No. 3,767,092 to Garrison et al. entitled "Garment Clamping Hanger with Slidable Locking Clip" discloses a clamping-type garment hanging device on which teeth generally indicated as 42 are placed to secure the garment to the hanger. These clamp-type garment hangers which utilize teeth, often sharp or otherwise pointed, suffer from the drawback of introducing unwanted creases, marks, holes, projections or disfigurations to the garment. Where the garment is especially delicate, these hangers heretofore in use can be particularly harmful to the garment.

U.S. Pat. No. 5,183,191 to Garrison et al. entitled "Hangers with Long Lasting Non-Slip Surfaces" discloses a clamp-type garment hanging device on which resilient pads 23 and 25 are molded. Pads 23 and 25 are adhered to or molded to both clamping surfaces of clamp 16 and 17 by an expensive and complicated process whereby resilient friction material, when in a molten state, is applied to the clamping surfaces of the jaw. U.S. Pat. No. 5,020,705 to Garrison entitled "Article Gripping Means and Method of Making Same" discloses a clamp-type garment hanging device on which gripping pads 20 are separately attached to both clamping surfaces of clamp 13. This attaching process is also expensive and introduces undesirable complexities into the manufacturing process. Moreover, the material from which these gripping pads have been made have an unwanted tendency to become sticky when subject to increased temperatures. This can become particularly harmful to garments when hangers of this sort are used to transport garments over long distances, often in very hot conditions. Further, U.S. Pat. No. 2,920,801 to Batts, entitled "Trousers Hanger," suffers from similar drawbacks. Thus, garments may be damaged or otherwise harmed by use of such hangers.

Each of these patents suffer from the drawback of either having sharp teeth which tend to damage the garment, or have no clamping surface which is easily formed and made, and which neither introduces complexities into the manufacturing process nor tends to harm the garment. In addition, these patents do not provide a clamping surface which yields superior clamping characteristics.

SUMMARY OF THE INVENTION

Accordingly, it is an object of the present invention to provide a clamp-type garment hanging device which does not leave an unwanted crease or imprint on the garment. It is a further object of the present invention to provide a clamp-type garment hanging device which is less expensive and faster and easier to manufacture than clamp-type garment hangers heretofore in use. It is a further object of the present invention to provide a clamp-type garment hanger which provides an equal or greater grip area, yet which gripping material does not stick to garments, or to its opposing grip area, when exposed to elevated temperatures.

In accordance with the preferred embodiment, a clamp-type garment hanger is disclosed which comprises at least one clamp attached to a body, the clamp having a hinge, the clamp further having at least two jaw members, wherein one jaw member is pivotable about the hinge, and where the other jaw member is not pivotable about the hinge, the jaw members being capable of a first open position where the one jaw member is pivoted away from the other jaw member, and a second closed position where the one jaw member is urged towards the other jaw member, one of the jaw members having a first gripping surface for gripping in the second closed position, wherein the first gripping surface is integrally formed with, and from the same materials as, the jaw member, such materials selected from the group consisting of polystyrene, polypropylene, polyethylene, styrene-butadiene copolymers and blends, polycarbonates, and combinations thereof.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings, wherein.

DETAILED DESCRIPTION OF THE PRESENTLY PREFERRED EXEMPLARY EMBODIMENT

Figure 1:
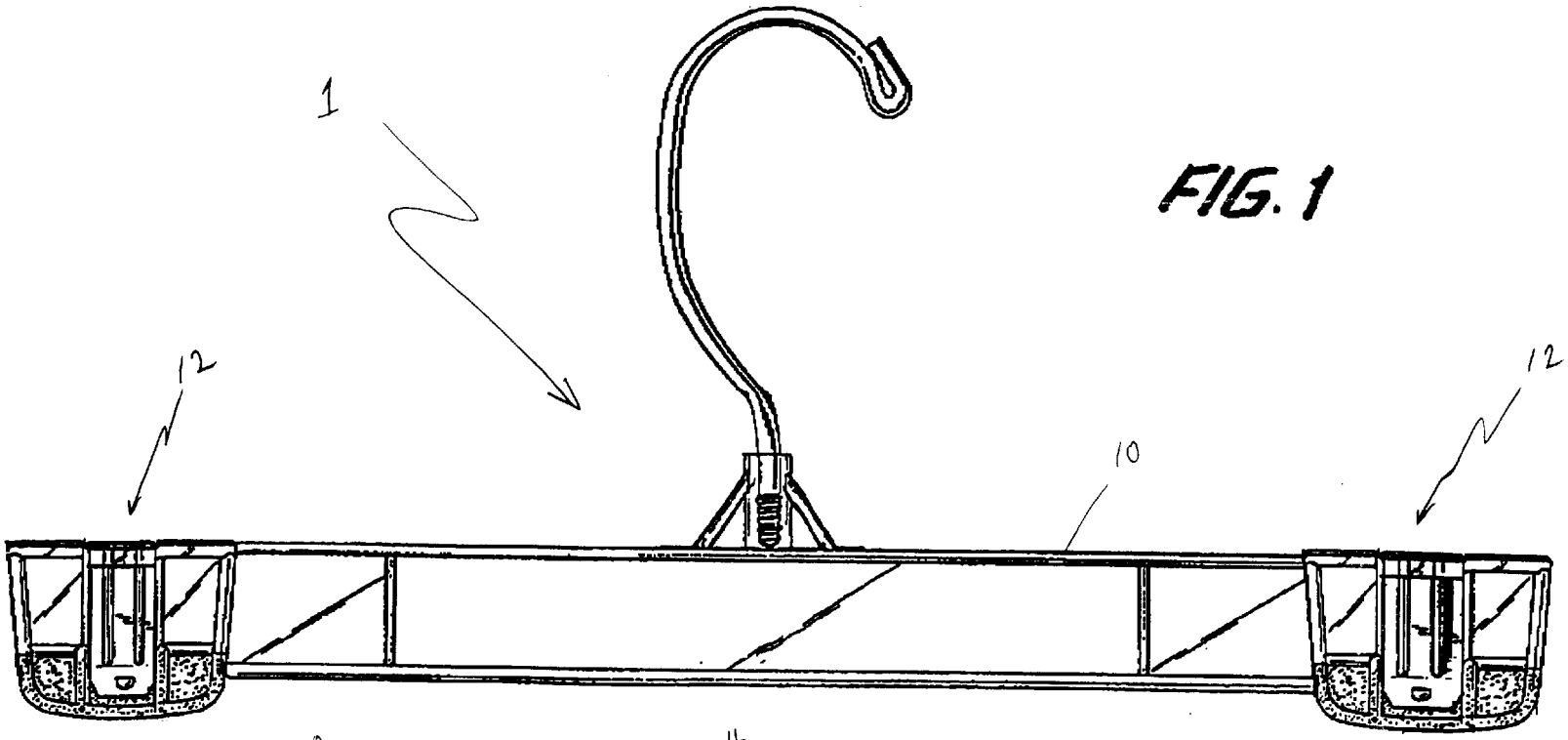
FIG. 1 is a rear view of the garment hanging device according to the present invention.

Referring now to FIG. 1, a clamp-type garment hanger 1 in accordance with the present invention is shown. Clamp-type garment hanger 1 includes a partial loop or hook member (not numbered), which may be formed from plastic or metal wire or any other appropriate material. The partial loop or hook member may be secured via threads to body 10, as shown, or may be integrally formed from the same material as body 10, or may be connected to the body in any other manner.

Clamp-type garment hanger has body 10, and has at its ends clamps generally indicated as 12. Clamps 12 are formed from the same material as body 10, and are also molded or otherwise formed integrally with, and from the same materials as, body 10. It is noted that, although shown with clamp 12 at each of its ends, the present invention recognizes that only one clamp 12 may be used.

Figure 3:
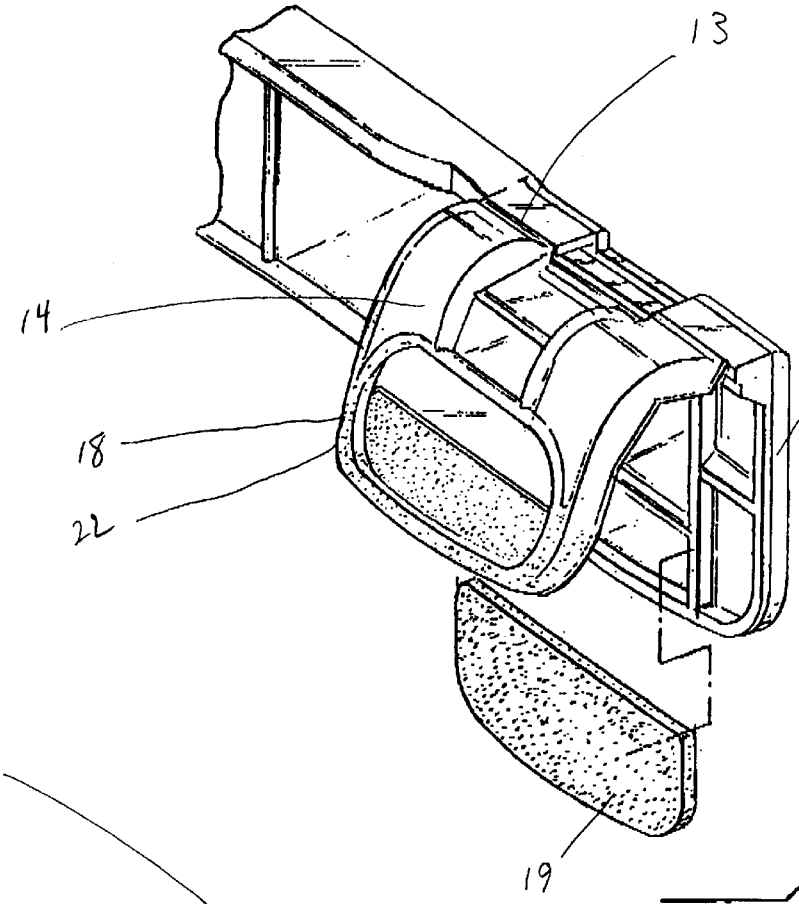
FIG. 3 is a perspective view of the garment hanging device according to the present invention.
Figure 4:
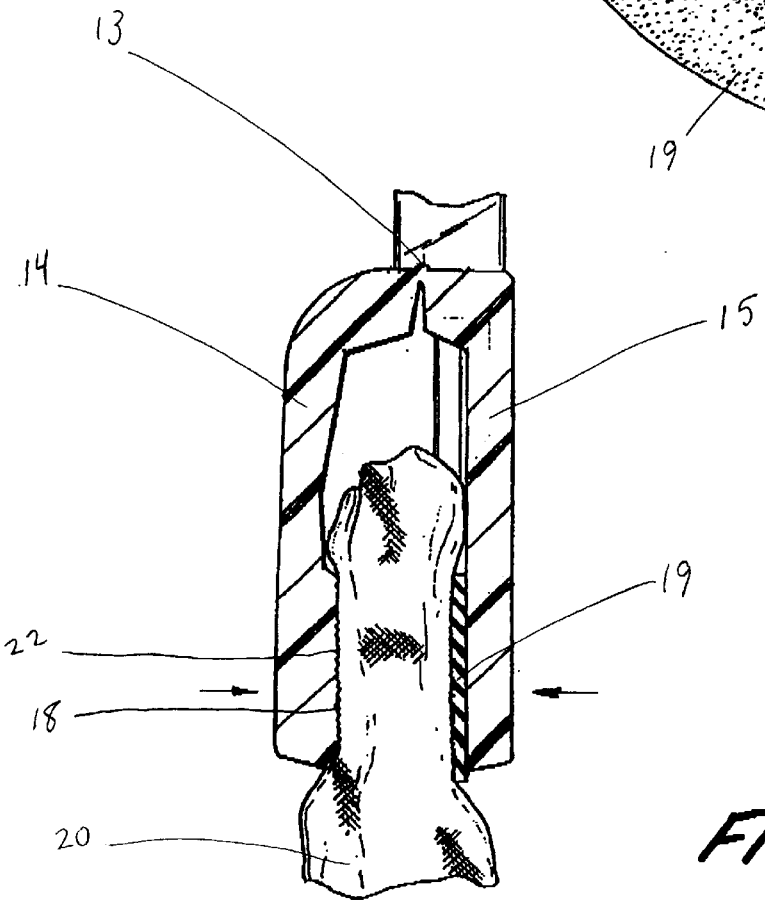
FIG. 4 is a side view of the garment hanging device according to the present invention.

As best shown in FIGS. 3 and 4, clamp 12 has along its upper edge a hinge 13. Clamp 12 includes a front jaw member 14 and a rear jaw member 15. One jaw member 14 or 15 has a gripping member 18 (although the figures depict jaw member 14 as having gripping member 18, it should be noted that either jaw member 14 or 15 may have gripping member 18). Gripping member 18, in turn, includes gripping surface 22. Hinge 13, jaw members 14 and 15, gripping member 18 and gripping surface 22 are integrally formed with the hanger body 10. That is, these elements of clamp 12 and hanger body 10 are all formed at the same time and from the same material or materials; the presently preferred embodiment contemplates that these materials may include polystyrene, polypropylene, polyethylene, styrene-butadiene copolymers and blends, polycarbonates, and combinations thereof. In addition, to increase the coefficient of friction of gripping surface 22, gripping surface 22 may be treated by engraving, acid etching, electrical discharge machining, vapor honing, sandblasting, or any other roughening process.

Jaw member 15, as best shown in FIGS. 3 and 4, has bonded thereto an elastomeric gripping pad 19. Preferably, the elastomer is a styrene elastomer, and is adhesively joined, such as by solvent bonding, to jaw member 15. However, the pad 19 may be formed from any one or more of the combination of styrene, ethylene, butadyne or propylene. Elastomeric pad 19 may alternatively be joined to jaw member 14, in which case, as discussed above, jaw member 15 would have gripping member 18 integrally formed therewith.

Figure 2:
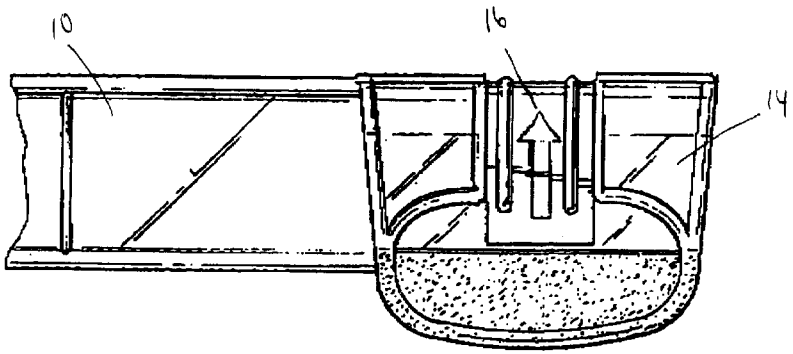
FIG. 2 is a close-up front view of the garment hanging device according to the present invention.

Front jaw member 14 is capable of pivoting about hinge 13, while rear jaw member 15 is stationary with respect to hinge 13. Clamp 12 also includes a biasing clip 16 which may be formed from a metal or any other appropriate material. Biasing clip 16 (shown in FIGS. 1 and 2), although part of clamp 12, is not integrally formed with clamp 12. As best shown in FIGS. 2 and 3, biasing clip 16 is positioned above hinge 13, and has two legs which respectively abut the front and rear jaw members 14 and 15, respectively.

Clamp 12 may occupy a closed position when biasing clip 16 is in its vertically lowered position, as shown in FIGS. 2 and 4. In this position, the legs of biasing clip 16, and more particularly the leg which abuts front jaw member 14, is lowered such that front jaw member 14 may not pivot about hinge 13. In this closed position, gripping members 18 via opposed gripping surfaces 22 serve to secure and support garment 20.

To release garment 20, the jaw members are moved into an open position. To achieve this open position, biasing clip 16 is moved to its raised position, as shown in FIG. 3, such that front jaw member 14 may pivot about axis 13 away from rear jaw member 15.

The present invention has the advantages of providing a clamping surface which is less damaging to the fabric of the garments than hangers heretofore in use. Also, because the gripping member, one jaw member and the gripping surface of the one jaw member are formed from the same material, manufacturing costs may be reduced, compared to prior hangers.

Having described the presently preferred exemplary embodiment of a new and improved garment hanging device in accordance with the present invention, it is believed that other modifications, variations and changes will be suggested to those of skill in the art in view of the teachings set forth herein. It is, therefore, to be understood that all such modifications, variations and changes are believed to fall within the scope of the present invention as defined by the claims appended hereto.

What is claimed is:

1. A clamp-type garment hanger having a body formed from a material, and a hook connected thereto, comprising:

at least one clamp integrally formed with, and from the same material as said body, said clamp having at least two jaw members, wherein at least one jaw member is pivotable relative to the other jaw member, said jaw members being capable of a first position where said one jaw member is pivoted, away from said other jaw member, and a second position where said one jaw member is urged towards said other jaw member, one of said one or said other jaw members having a first gripping surface for gripping in said second position, said first gripping surface being substantially smoother and free of projections, said first gripping surface being integrally formed with, and from the same material as the one of said one or said other jaw members, said first gripping surface being lightly roughened and treated by a treatment selected from a group consisting of engraving, acid etching, electrical discharge machining, vapor honing and sandblasting to have a coefficient of friction greater than a Coefficient of friction of said material, and said other jaw member having an elastomeric gripping pad.

2. A clamp-type garment hanger according to claim 1, wherein said material may be selected from the group consisting of polystyrene, polypropylene, polyethylene, styrene-butadiene copolymers and blends, polycarbonates, and combinations thereof.

3. A clamp-type hanger according to claim 1, wherein said first gripping surface is treated by engraving to increase its coefficient of friction.

4. A clamp-type hanger according to claim 1, wherein said first gripping surface is treated by acid etching to increase its coefficient of friction.

5. A clamp-type hanger according to claim 1, wherein said first gripping surface is treated by electrical discharge machining to increase its coefficient of friction.

6. A clamp-type hanger according to claim 1, wherein said first gripping surface is treated by vapor honing to increase its coefficient of friction.

7. A clamp-type hanger according to claim 1, wherein said first gripping surface is treated by sandblasting to increase its coefficient of friction.

8. A clamp-type hanger according to claim 1, wherein said gripping pad is formed from a styrene elastomer material.

9. A clamp-type hanger according to claim 8, wherein said gripping pad is adhesively joined to the other of said one or said other jaw members.

10. A clamp-type hanger according to claim 9, wherein said gripping pad is; solvent bonded to the other of said one or said other jaw members.

11. A clamp-type garment hanger having a body formed from a material, and a hook connected thereto, comprising:

at least one clamp integrally formed with, and from the same material as said body, said clamp having a hinge, said clamp having at least tow jaw members, wherein one jaw member is pivotable about said hinge, and where the other jaw member is stationary with respect to said hinge, said jaw members being capable of a first position where said one jaw member is pivoted away from said other jaw member, and a second position where said one jaw member is urged towards said other jaw member, one of said one or said other jaw members having a first gripping surface for gripping in said second position, said first gripping surface being integrally formed with, and from the same material as the one of said one or said other jaw members, said first gripping surface being substantially smooth and free of projections, wherein the other of said one or said other jaw members includes a gripping pad formed from an elastomeric material, said gripping pad having a second gripping surface which cooperates with said first gripping surface for gripping in said second position, and further wherein said first gripping surface being lightly roughened and treated by a treatment selected from the group consisting of engraving, acid etching, electrical discharge machining, valor honing and sandblasting to have a coefficient of friction greater than a coefficient of friction of said material.

12. A clamp-type hanger according to claim 11, wherein said material is selected from the group consisting of polystyrene, polypropylene, polyethylene, styrene-butadiene copolymers and blends, polycarbonates, and combinations thereof.

13. A clamp-type hanger according to claim 11, wherein said gripping pad is either adhesively joined or solvent bonded to the other of said one or said other jaw members.

* * * * *